US009664360B1

(12) United States Patent
Orr

(10) Patent No.: US 9,664,360 B1
(45) Date of Patent: May 30, 2017

(54) LIGHTING CANISTER STAND ASSEMBLY

(71) Applicant: Clarence Eugene Orr, Pueblo West, CO (US)

(72) Inventor: Clarence Eugene Orr, Pueblo West, CO (US)

( * ) Notice: Subject to any disclaimer, the term of this patent is extended or adjusted under 35 U.S.C. 154(b) by 13 days.

(21) Appl. No.: 14/332,296

(22) Filed: Jul. 15, 2014

(51) Int. Cl.
*F21V 19/00* (2006.01)
*F21V 21/04* (2006.01)
*F21S 8/02* (2006.01)
*F21V 23/02* (2006.01)

(52) U.S. Cl.
CPC ..... *F21V 21/04* (2013.01); *F21S 8/022* (2013.01); *F21V 23/02* (2013.01); *F21V 23/023* (2013.01); *F21V 23/026* (2013.01)

(58) Field of Classification Search
CPC ..... F21V 23/02; F21V 23/023; F21V 23/026; F21V 21/04; F21S 8/022
USPC ..... 362/382
See application file for complete search history.

(56) References Cited

U.S. PATENT DOCUMENTS 3,225,224 A * 12/1965 Rydbeck ..... E04H 5/04 174/45 R
3,242,252 A * 3/1966 Bergenstein ..... F21V 23/02 174/38
4,077,076 A * 3/1978 Masters ..... B63B 1/02 116/107
4,114,186 A * 9/1978 Dominguez ..... F21S 19/005 362/150
4,343,033 A * 8/1982 Suzuki ..... B64F 1/20 362/145
4,396,972 A * 8/1983 Kaneko ..... B64F 1/205 362/145
5,065,292 A * 11/1991 Aubrey ..... F21S 6/002 362/260
7,188,967 B2 * 3/2007 Dalton et al. ..... 362/205
7,261,443 B1 * 8/2007 Hayes, Jr. ..... F21S 2/00 362/285
7,534,009 B2 * 5/2009 Trojanowski ..... B60Q 1/2611 362/234
8,827,512 B1 * 9/2014 Beadle ..... F21S 8/083 362/153
2004/0201992 A1 * 10/2004 Dalton ..... F21S 9/02 362/276
2005/0247920 A1 * 11/2005 Burkart ..... E04H 17/20 256/1
2009/0175046 A1 * 7/2009 Richard ..... F21S 8/081 362/431

* cited by examiner

*Primary Examiner* — Robert May
*Assistant Examiner* — Bryon T Gyllstrom
(74) *Attorney, Agent, or Firm* — Plager Schack LLP

(57) ABSTRACT

A lighting canister stand assembly is configured to elevate a transformer above a canister drain pipe within a canister underground. The lighting canister stand assembly has a lighting canister stand, further including a lighting canister rod mechanically coupled to a first side of a lighting canister platform. The canister further comprising a canister bottom, immediately adjacent to the lighting canister rod, and a canister wall immediately adjacent to an edge of the lighting canister platform. The lighting canister platform is configured to elevate the transformer above the canister drain pipe in order to permit water to drain out of the canister and away from the transformer.

4 Claims, 3 Drawing Sheets

LIGHTING CANISTER STAND ASSEMBLY

BACKGROUND

The embodiments herein relate generally to outdoor lighting assemblies.

A transformer is an electrical device that transfers energy between two or more circuits through electromagnetic induction. A varying current in the transformer's primary winding creates a varying magnetic flux in the core and a varying magnetic field impinging on the secondary winding. This varying magnetic field at the secondary induces a varying electromotive force (emf) or voltage in the secondary winding. Making use of Faraday's Law in conjunction with high magnetic permeability core properties, transformers can thus be designed to efficiently change alternating current voltages and amperage from one voltage level to another within power networks.

Prior to embodiments of the disclosed invention, an outdoor light assembly comprised a transformer which rested in a can and converted source AC power to a local AC power necessary for operating the light. However, the transformer sat on the wires and over time, damages the wires, causing the circuit short out. Further, the transformer also covered the drain hole and cause retention of water in the can.

Prior art solutions involved stacking bricks in the can in order to lift the transformer from the bottom of the can. However, bricks obscured draining holes in the bottom of the can. Embodiments of the disclosed invention solve these problems.

SUMMARY

A lighting canister stand assembly is configured to elevate a transformer above a canister drain pipe within a canister underground. The lighting canister stand assembly has a lighting canister stand, further including a lighting canister rod mechanically coupled to a first side of a lighting canister platform. The canister further comprising a canister bottom, immediately adjacent to the lighting canister rod, and a canister wall immediately adjacent to an edge of the lighting canister platform. The lighting canister platform is configured to elevate the transformer above the canister drain pipe in order to permit water to drain out of the canister and away from the transformer.

In some embodiments, a high friction surface can be attached to a second side of the lighting canister platform. The high friction surface prevents the transformer from moving off of the lighting canister platform.

In some embodiments an angle of the lighting canister rod can be measured between the first side and the lighting canister rod is at least 153 degrees but no more than 173 degrees. In some embodiments, the angle is 163 degrees.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
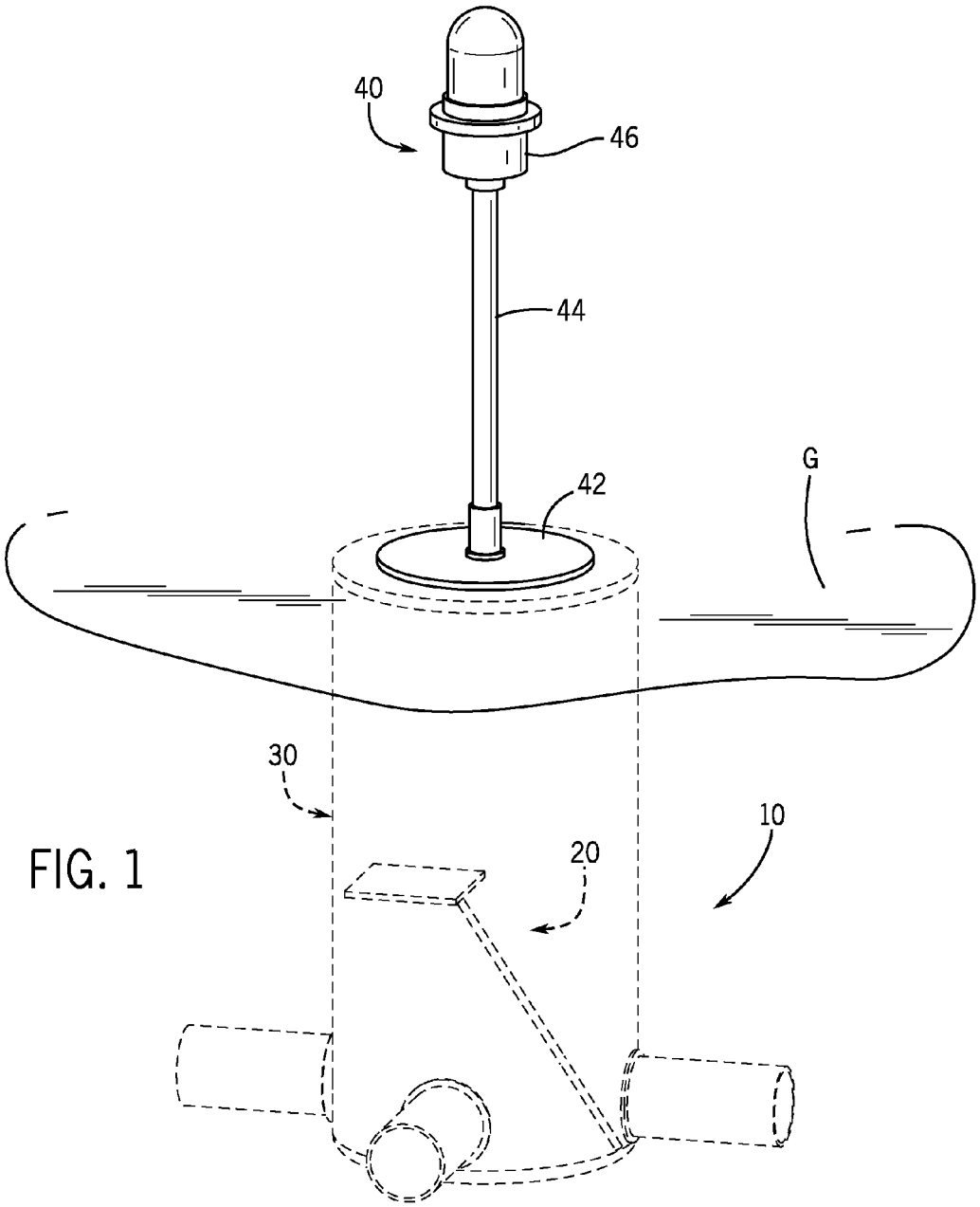
FIG. 1 is a perspective view of an embodiment of the invention.

By way of example, and referring to FIG. 1, and FIG. 2, lighting canister stand assembly 10 is partially above ground G and partially below ground G. Lighting canister stand assembly 10 comprises lighting canister stand 20 placed inside canister 30. Canister 30 is connected to lighting assembly 40.

Figure 4:
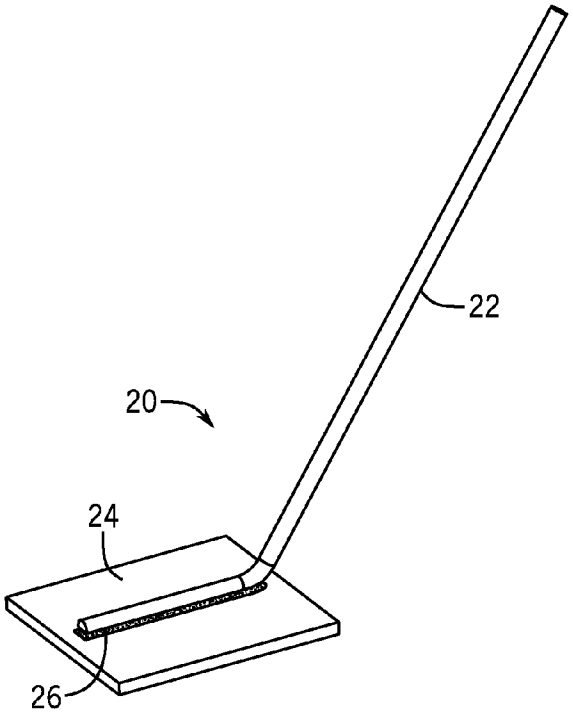
FIG. 4 is an inverted perspective view of an embodiment of the invention.
Figure 3:
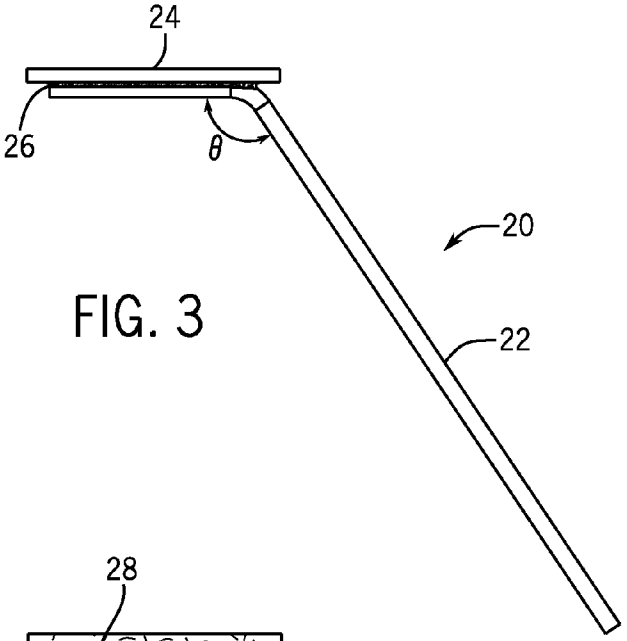
FIG. 3 is a side elevation view of an embodiment of the invention.
Figure 5:
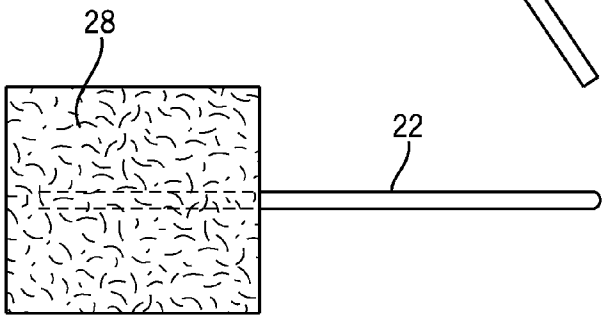
FIG. 5 is a top view of an embodiment of the invention.

Turning to FIG. 3, FIG. 4 and FIG. 5, lighting canister stand 20 further comprises lighting canister rod 22 mechanically coupled to a first side of lighting canister platform 24 with attachment 26. In some embodiments, attachment 26 is welding. A second side of lighting canister platform 24 is mechanically coupled to high friction surface 28. In some embodiments, high friction surface 28 is rubber.

Figure 2:
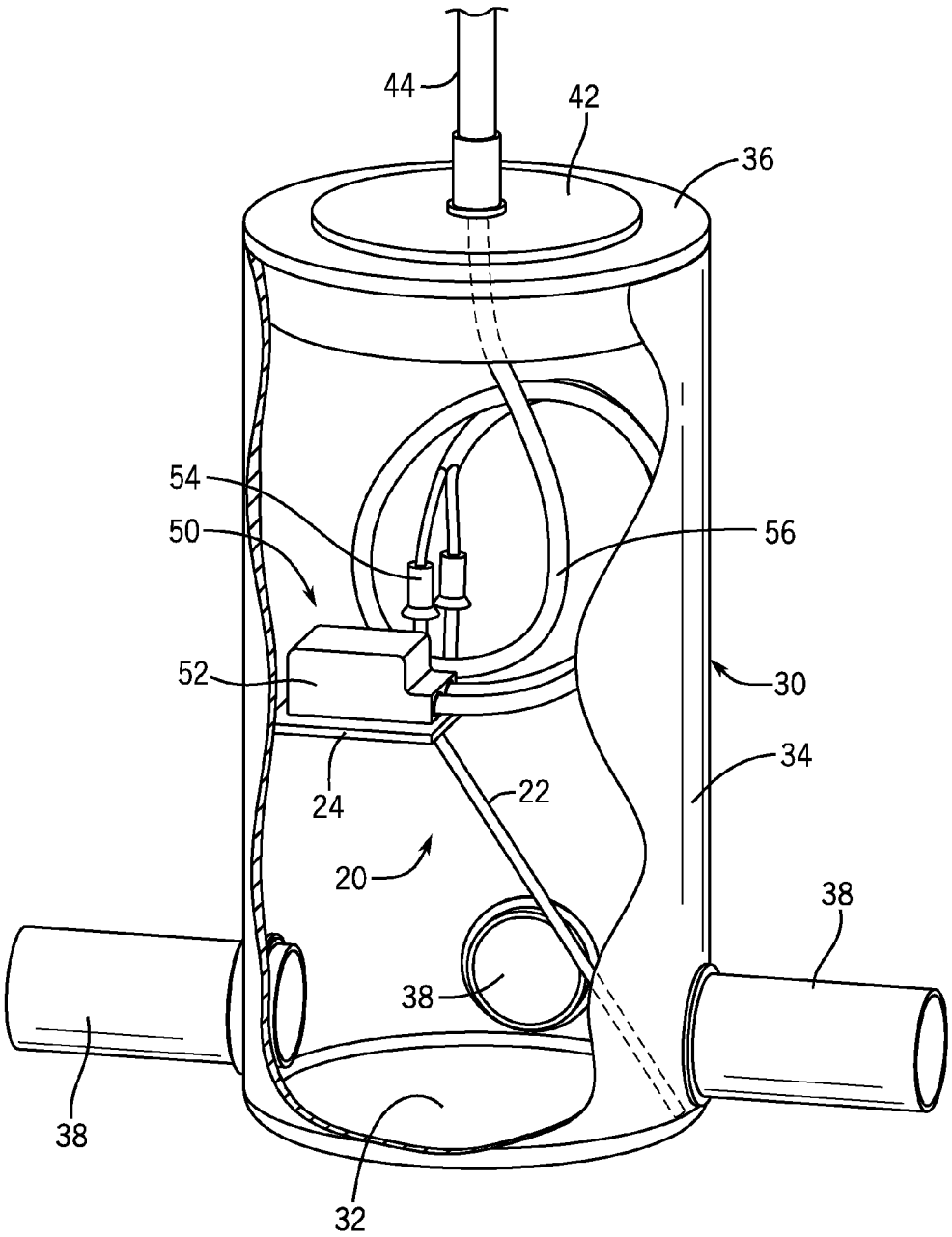
FIG. 2 is a perspective view of an embodiment of the invention with parts broken away.

Turning to FIG. 2, canister 30 further comprises canister bottom 32 mechanically coupled to canister wall 34. Canister wall 34 is mechanically coupled to canister top 36. Canister top 36 is attached to lighting base 42. Canister wall 34 is perforated with canister drain pipes 38 in order to drain water from canister 30.

Lighting assembly 40 further comprises lighting base 42 mechanically coupled to lighting pole 44. Lighting pole 44 is further mechanically coupled to light 46. Lighting pole 44 is a hollow tube.

Power assembly 50 comprises transformer 52 electrically coupled to power source wires 54 and power output wires 56. Power output wires 56 are electrically coupled to light 46 through lighting pole 44.

The high friction surface has a surface area greater than the transformer surface area. In some embodiments, the surface area is four inches by four inches. Lighting canister rod 22 should be as narrow as possible while not being so narrow as to plastically deform under the weight of lighting canister platform 24, high friction surface 28 and transformer 52. Further, angle $\theta$ should be maximized so as to evenly distribute the vertical forces from lighting canister platform 24, high friction surface 28 and transformer 52. Experimentation has indicated that 153 degrees<angle $\theta$<173 degrees. Ideally, angle $\theta$ is 163 degrees. An edge of lighting canister platform 24 is immediately adjacent to canister wall 34, contacting canister wall 34 at two points in order to avoid tipping over. Here, canister wall 34 is concave and the edge is flat such that the edge engages canister wall 34 at two points. This geometry is one example of an effective solution to maintain transformer 52 in place.

Further, transformer 52 should be elevated above canister drain pipes 38 in order to avoid obstructing the flow of water away from canister 30. Likewise, lighting canister platform 24 should have its size minimized in order to avoid blocking a flow of water toward canister drain pipes 38. In this regard, lighting canister rod 22 should be immediately adjacent to canister bottom 32 and not within canister drain pipe 38.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A lighting canister stand assembly, configured to elevate a transformer; the lighting canister stand assembly comprising:

a lighting canister stand, further comprising a lighting canister rod mechanically coupled to a first side of a lighting canister platform;

a canister further comprising a canister bottom, immediately adjacent to the lighting canister rod, and a canister wall immediately adjacent to an edge of the lighting canister platform;

drain pipes perforating the canister wall above the bottom and perpendicular to the bottom and configured to drain water from the canister;

wherein the lighting canister platform is configured to elevate the transformer above the canister drain pipe in order to permit water to drain out of the canister and away from the transformer.

2. The lighting canister stand assembly of claim 1, further comprising a high friction surface attached to a second side of the lighting canister platform; wherein the high friction surface prevents the transformer from moving off the lighting canister platform; and wherein the drain pipes further comprise four holes evenly spaced around the canister wall.

3. The lighting canister stand assembly of claim 2, wherein an angle of the lighting canister rod measured between the first side and the lighting canister rod is at least 153 degrees but no more than 173 degrees.

4. The lighting canister stand assembly of claim 3, wherein the angle is 163 degrees.

* * * * *